US010760187B2

(12) United States Patent
Terada et al.

(10) Patent No.: US 10,760,187 B2
(45) Date of Patent: Sep. 1, 2020

(54) HYBRID FIBER

(71) Applicant: PANASONIC INTELLECTUAL PROPERTY MANAGEMENT CO., LTD., Osaka (JP)

(72) Inventors: Tsuyoshi Terada, Osaka (JP); Kazushige Sugita, Hyogo (JP); Tomohiro Kanazawa, Osaka (JP); Daichi Ikeuchi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 168 days.

(21) Appl. No.: 15/808,264

(22) Filed: Nov. 9, 2017

(65) Prior Publication Data

US 2018/0135211 A1 May 17, 2018

(30) Foreign Application Priority Data

Nov. 15, 2016 (JP) ..... 2016-222572

(51) Int. Cl.

| | |
|---|---|
| ***D02G 3/04*** | (2006.01) |
| ***D02G 3/12*** | (2006.01) |
| ***D02G 3/44*** | (2006.01) |

(52) U.S. Cl.

CPC ..... *D02G 3/047* (2013.01); *D02G 3/12* (2013.01); *D02G 3/44* (2013.01); *D02G 3/442* (2013.01)

(58) Field of Classification Search

CPC ..... D02G 3/047; D02G 3/442; D02G 3/04; D02G 3/042; D02G 3/02; D02G 3/22

See application file for complete search history.

(56) References Cited

U.S. PATENT DOCUMENTS

| | | | | | |
|---|---|---|---|---|---|
| 1,911,310 | A * | 5/1933 | Ellis | D21F 1/36 | 162/357 |
| 4,384,449 | A * | 5/1983 | Byrnes, Sr. | A41D 19/01511 | 139/425 R |
| 4,759,981 | A * | 7/1988 | Weil | B23K 9/0356 | 219/160 |
| 5,224,363 | A * | 7/1993 | Sutton | A41D 19/0058 | 66/202 |
| 5,342,252 | A * | 8/1994 | Fujiwara | F16G 1/28 | 474/266 |
| 5,532,434 | A * | 7/1996 | Takeno | B23K 26/18 | 174/110 A |
| 6,277,771 | B1 * | 8/2001 | Nishimura | B29C 70/22 | 442/229 |

FOREIGN PATENT DOCUMENTS

| | | | |
|---|---|---|---|
| CN | 201507573 | U * | 6/2010 |
| CN | 104972402 | A * | 10/2015 |
| CN | 204784349 | U * | 11/2015 |
| JP | 2005-256212 | A | 9/2005 |
| WO | 2013/039195 | A1 | 3/2013 |

* cited by examiner

*Primary Examiner* — Ismael Izaguirre

(74) *Attorney, Agent, or Firm* — McDermott Will & Emery LLP

(57) ABSTRACT

A hybrid fiber which includes: a metal wire having a roughened surface; and a fiber is provided. In the hybrid fiber, the metal wire and the fiber are combined.

13 Claims, 4 Drawing Sheets

HYBRID FIBER

CROSS REFERENCE TO RELATED APPLICATION

This application claims the benefit of priority of Japanese Patent Application Number 2016-222572 filed on Nov. 15, 2016, the entire content of which is hereby incorporated by reference.

BACKGROUND

1. Technical Field

The present disclosure relates to a hybrid fiber.

2. Description of the Related Art

Conventionally, fiber products such as clothing are manufactured using chemical fibers or natural fibers. A fiber including a material suitable for a utilization purpose such as resistance to cutting is used for a fiber product (see, for example, Japanese Unexamined Patent Application Publication No. 2005-256212).

SUMMARY

In recent years, not only fiber products used for the purpose of resistance to cutting but also fiber products for various usages are demanded. In order to manufacture fiber products suitable for the various usages, fibers having intended functions need to be used.

In view of the above, an object of the present disclosure is to provide a hybrid fiber having an intended function.

In order to achieve the above-described object, a hybrid fiber according to an aspect of the present disclosure includes: a metal wire having a roughened surface; and a fiber, in which the metal wire and the fiber are combined.

With the present disclosure, it is possible to provide a hybrid fiber having an intended function.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

The following describes in detail a hybrid fiber according to an embodiment of the present disclosure, with reference to the drawings. It should be noted that the embodiment described below indicates one specific example of the present disclosure. The numerical values, shapes, materials, structural components, the disposition and connection of the structural components, etc. described in the following embodiment are mere examples, and do not intend to limit the present disclosure. Furthermore, among the structural components in the following exemplary embodiment, components not recited in the independent claim which indicates the broadest concept of the present invention are described as arbitrary structural components.

In addition, each diagram is a schematic diagram and not necessarily strictly illustrated. Accordingly, for example, scale sizes, etc., are not necessarily exactly represented. In each of the diagrams, substantially the same structural components are assigned with the same reference signs, and redundant descriptions will be omitted or simplified.

Embodiment (Configuration)

Figure 1:
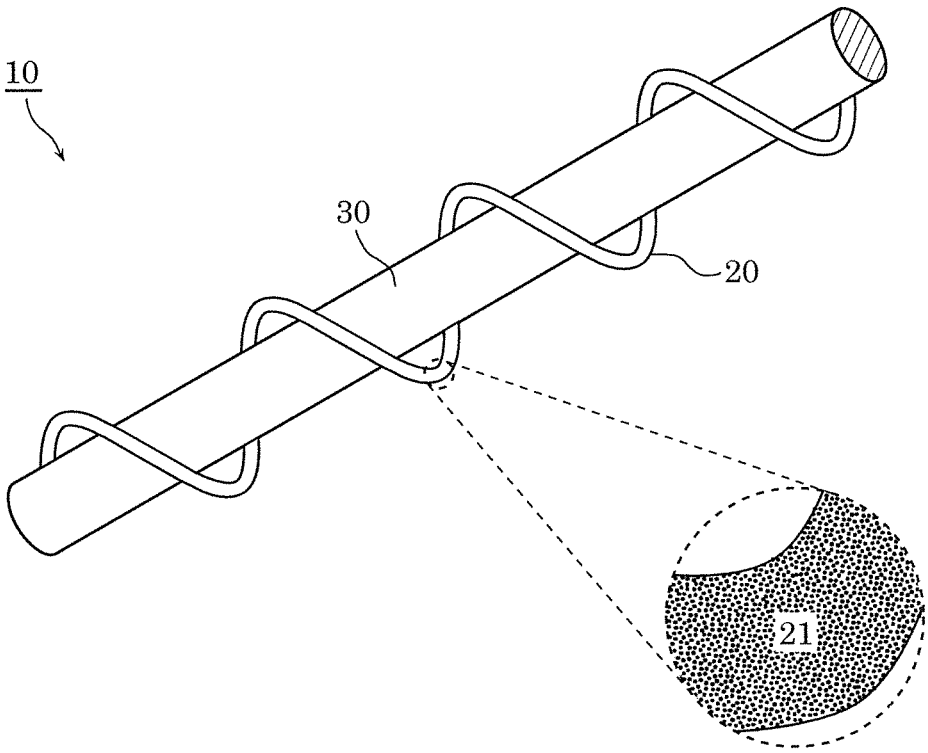
FIG. 1 is a schematic diagram which illustrates a hybrid fiber according to an embodiment.

First, a configuration of a hybrid fiber which can be used in various fiber products will be described with reference to FIG. 1. FIG. 1 is a schematic diagram which illustrates hybrid fiber 10 according to the embodiment.

As illustrated in FIG. 1, hybrid fiber 10 includes metal wire 20 and fiber 30. More specifically, metal wire 20 and fiber 30 are combined into hybrid fiber 10. According to the embodiment, in hybrid fiber 10, metal wire 20 is wound around fiber 30 as a core thread forming a covered yarn. More specifically, fiber 30 as a core thread is strained and fixed, and metal wire 20 as a sheath thread is wound around fiber 30 (i.e., covering processing is carried out), thereby manufacturing hybrid fiber 10.

It should be noted that the number of twisting of metal wire 20 (the number of times that a sheath thread is wounded around a core thread of 1 meter) is not specifically limited. As illustrated in FIG. 1, metal wire 20 may have a gap between one winding and the next winding, or adjacent windings may be in close contact with each other.

Surface treatment is applied to metal wire 20. Specifically, surface treatment for setting surface roughness Ra to be in a predetermined range is applied to surface 21 of metal wire 20. More specifically, surface 21 of metal wire 20 is roughened. According to the embodiment, surface roughness Ra of metal wire 20 is, for example, in a range from 0.15 μm to 0.25 μm.

According to the present embodiment, metal wire 20 has a diameter less than a diameter of fiber 30. More specifically, the diameter of metal wire 20 is less than or equal to 80 μm, and is, for example, 30 μm or the like. Since the diameter of metal wire 20 is sufficiently small, metal wire 20 has an increased flexibility, and thus metal wire 20 is easily bent. This facilitates performing of the covering processing.

Metal wire 20 is specifically a tungsten wire. Surface roughness Ra of a tungsten wire having surface 21 which is not roughened is, for example, less than or equal to 0.10 μm. The tungsten wire is manufactured using pure tungsten. More specifically, the degree of purity of the tungsten wire is 99.9% or higher. The degree of purity of the tungsten wire may be 95% or higher, for example. However, the degree of purity of the tungsten wire is not limited to this example. The tungsten wire has a circular cross-section shape. However, the shape of the tungsten wire is not limited to this example.

An ultrafine tungsten wire (metal wire 20) can be manufactured, for example, in such a manner as described below. First, a tungsten powder having a grain size of 5 μm is press-molded and sintered to be in a form of a tungsten ingot. Next, a block of tungsten in the form of the ingot is subjected to swaging processing in which the tungsten ingot is press-forged from its periphery and extended to be in a form of a wire. Subsequently, drawing (wire drawing) using wire drawing dies is performed. The drawing is performed by using wire drawing dies having pore diameters different from one another, in descending order of the pore diameters.

For example, when a weight ratio of an amount of oxide included in the tungsten wire having a mass of 50 MG is in a range from 0.2% to 0.5%, the drawing is started by using a single crystal diamond die having a pore diameter of 200 μm as the first die. In this manner, it is possible to manufacture a tungsten wire having surface roughness Ra of 0.10 μm or less. It should be noted that "MG" is a unit which indicates a numerical value representing, in milligrams, a mass of a wire having a length of 200 mm.

Subsequently, surface treatment is applied to the tungsten wire having an intended diameter. More specifically, a surface of the tungsten wire is roughened, thereby defining fine unevenness on the surface. For example, the tungsten wire is caused to be in contact with an agent, thereby defining fine unevenness on the surface.

The agent is, for example, a hydrogen peroxide solution ($H_2O_2$) or an alkaline solution. It is possible to cause the entire surface of the tungsten wire to be in contact with an agent, by soaking a tungsten wire in an agent in a container of a suitable size. It should be noted that the tungsten wire may be squirted with an agent, using a spray or the like. In this manner, a tungsten wire (metal wire 20) having a surface that is roughened is manufactured. More specifically, a tungsten wire (metal wire 20) having surface 21 having surface roughness Ra in a range from 0.15 μm to 0.25 μm is manufactured.

The tensile strength of a tungsten wire increases as a result of performing the drawing using a plurality of wire drawing dies. In other words, the tungsten wire is less likely to break off even when the tungsten wire is made ultrafine, or rather, increases in strength by being made ultrafine. For example, there is an advantageous effect that an ultrafine tungsten wire having a diameter of 22 μm or less is high in tensile strength and hardness, and is easily bent and processed.

Fiber 30 is, for example, a chemical fiber, such as an aramid fiber or a nylon fiber. As the aramid fiber, for example, a fiber manufactured using an aromatic polyamide resin material such as Kevlar (registered trademark) can be used. As the nylon fiber, for example, a fiber manufactured using ultrahigh molecular weight polyethylene such as Dyneema (registered trademark) can be used.

It should be noted that the chemical fibers used as fiber 30 are not limited to the above-described examples, and other polyethylene, polyurethane, polyvinyl chloride, acrylic, etc., can be used. In addition, fiber 30 may be a natural fiber such as a plant fiber, an animal fiber, etc.

According to the present embodiment, a diameter of fiber 30 is larger than a diameter of metal wire 20, and is 100 μm for example. However, the diameter of fiber 30 is not limited to this example.

(Advantageous Effects, Etc.)

As described above, metal wire 20 having surface 21 that is roughened and fiber 30 are combined into hybrid fiber 10 according to the embodiment. For example, in hybrid fiber 10, metal wire 20 is wound around fiber 30 as a core thread forming a covered yarn.

In this manner, since hybrid fiber 10 includes metal wire 20, it is possible to exert various functions using the properties of metal materials included in metal wire 20. For example, use of a hard metal material makes it possible to use hybrid fiber 10 for manufacturing fiber products used for the purpose of resistance to cutting. Alternatively, it is possible to use hybrid fiber 10 for manufacturing electrically conductive fiber products, using the conductive property of the metal material. In addition, use of a metal material having a large atomic weight makes it possible to use hybrid fiber 10 for manufacturing fiber products used for the purpose of shielding radiation.

In addition, since hybrid fiber 10 includes fiber 30, metal wire 20 has an extra length for allowing extension and contraction in the longitudinal direction of fiber 30. For that reason, it is possible to increase extension and contraction properties compared to a hybrid fiber including only metal wire 20. Since the extension and contraction properties of hybrid fiber 10 are increased, hybrid fiber 10 is easily used for clothing materials.

In this manner, with the present disclosure, it is possible to provide hybrid fiber 10 having an intended function.

Moreover, since surface 21 of metal wire 20 is roughened, metal wire 20 and fiber 30 are easily engaged. In other words, metal wire 20 is less likely to slip on fiber 30, and thus adhesion between metal wire 20 and fiber 30 increases. For that reason, metal wire 20 and fiber 30 are less likely to ravel.

With this configuration, when a fiber product is manufactured using hybrid fiber 10, and when the manufactured fiber product is used, breaking off or raveling of lines is suppressed. Accordingly, use of hybrid fiber 10 according to the embodiment makes it possible to manufacture a high-quality fiber product which can exert functions for a long period of time.

In addition, for example, metal wire 20 has surface roughness Ra in a range from 0.15 μm to 0.25 μm.

With this configuration, it is possible to increase adhesion between metal wire 20 and fiber 30. For example, metal wire 20 having surface 21 which is not roughened has surface roughness Ra less than or equal to 0.10 μm, and thus metal wire 20 is likely to slip on fiber 30. For that reason, metal wire 20 and fiber 30 are more likely to ravel. As surface roughness Ra increases above 0.10 μm, slipping of metal wire 20 on fiber 30 is increasingly suppressed. When surface roughness Ra is greater than or equal to 0.15 μm, adhesion between metal wire 20 and fiber 30 is sufficiently high, and thus metal wire 20 and fiber 30 are less likely to ravel.

In addition, since surface roughness Ra is less than or equal to 0.25 μm, smoothness is ensured to a certain degree. For that reason, covering processing can be easily carried out, and thus manufacturing of hybrid fiber 10 is facilitated. Furthermore, for example, when a fiber product is manufactured using hybrid fiber 10 and performing weaving processing or knitting processing, it is possible to suppress wearing of a weaving machine or a knitting machine.

In addition, for example, metal wire 20 is a tungsten wire.

With this configuration, since tungsten is high in Mohs hardness, it is possible to increase a cut resistance property of hybrid fiber 10. In addition, since tungsten has a large atomic weight, it is possible to increase the effect of shielding radiation by hybrid fiber 10. Furthermore, since a melting point of tungsten is sufficiently high compared to stainless steel or the like, it is possible to increase the thermal resistance of hybrid fiber 10.

In addition, for example, metal wire 20 has a diameter smaller than a diameter of fiber 30.

With this configuration, it is possible to manufacture a fiber product which feels better to the touch and against the skin, by using metal wire 20 that is thinner than fiber 30. For example, when a person wears a fiber product such as a clothing item manufactured using hybrid fiber 10, tingling sensation that the person might feel is sufficiently alleviated, and thus it is possible for the person to wear the clothing item without feeling a sense of discomfort. In particular, since the strength of a tungsten wire is increased by being made ultrafine, it is possible to manufacture a fiber product such as a clothing item which excels in the strength and can be worn without a sense of discomfort, by using the ultrafine tungsten wire as metal wire 20.

In addition, for example, fiber 30 is at least one of an aramid fiber and a nylon fiber.

With this configuration, for example, since an aramid fiber such as Kevlar, or a nylon fiber such as Dyneema is high in the hardness, it is possible to further increase the cut resistance property of hybrid fiber 10.

(Modification)

The following describes a modification example of the hybrid fiber according to the embodiment.

The present modification example is different from the embodiment in how metal wire 20 and fiber 30 are combined. The following description focuses on the difference from the embodiment, and description for common points are omitted or simplified.

Figure 2:
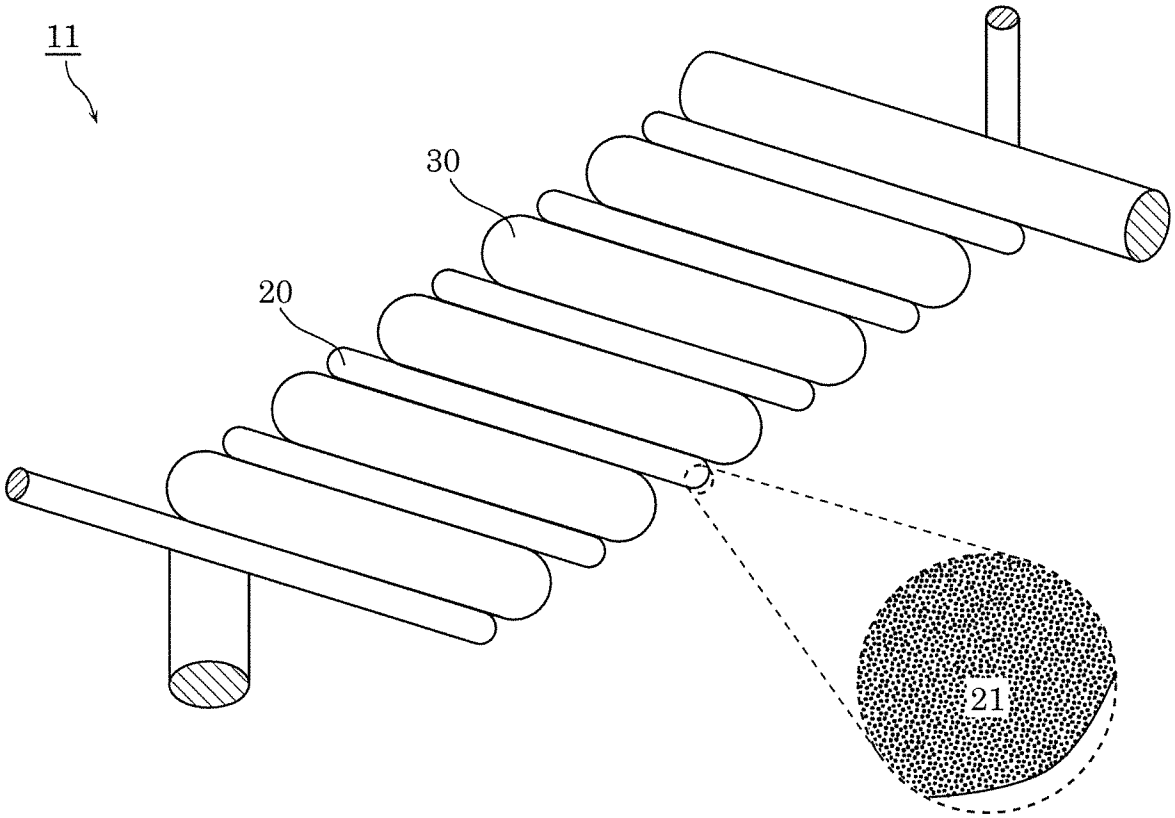
FIG. 2 is a schematic diagram which illustrates a hybrid fiber according to a modification example of the embodiment.

FIG. 2 is a schematic diagram which illustrates hybrid fiber 11 according to the present modification example. As illustrated in FIG. 2, in hybrid fiber 11, metal wire 20 and fiber 30 are twisted together forming a piled yarn. More specifically, hybrid fiber 11 is manufactured by placing side by side and twisting metal wire 20 and fiber 30 (i.e., by applying twisting processing to metal wire 20 and fiber 30). Hybrid fiber 11 includes metal wire 20 and fiber 30 which have different widths (diameters) and are twisted together.

As with hybrid fiber 10, hybrid fiber 11 according to the present modification example is capable of exerting an intended function. In addition, since surface 21 of metal wire 20 is roughened, the adhesion between metal wire 20 and fiber 30 is increased, and thus metal wire 20 and fiber 30 are less likely to ravel.

(Method of Manufacturing Hybrid Fiber)

Figure 3:
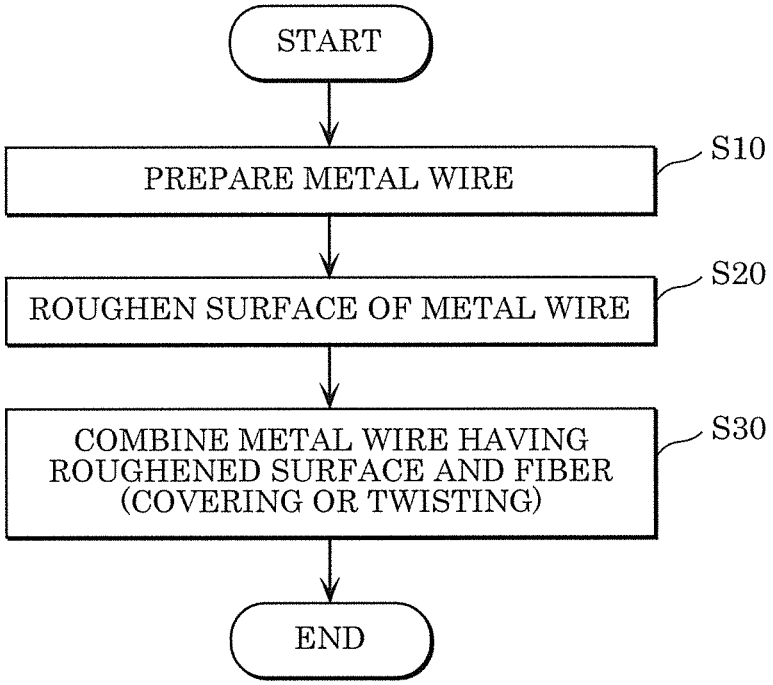
FIG. 3 is a flowchart illustrating an example of a method of manufacturing the hybrid fiber according to the embodiment.

The following describes a method of manufacturing hybrid fiber 10 or 11 according to the embodiment, with reference to FIG. 3. FIG. 3 is a flowchart illustrating a method of manufacturing hybrid fiber 10 or 11 according to the embodiment As illustrated in FIG. 3, first, metal wire 20 of less than or equal to a predetermined diameter is prepared (S10). More specifically, an ultrafine tungsten wire having a diameter less than or equal to 80 μm (for example, less than or equal to 22 μm) is manufactured by performing drawing using a plurality of wire drawing dies. In this manner, metal wire 20 having smooth surface 21 is prepared. Surface roughness Ra of prepared metal wire 20 (tungsten wire) is, for example, less than or equal to 0.10 μm.

Next, surface 21 of prepared metal wire 20 is roughened (S20). For example, metal wire 20 is soaked in a hydrogen peroxide solution ($H_2O_2$) or an alkaline solution, thereby roughening surface 21. In this manner, metal wire 20 having surface roughness Ra in a range from 0.15 μm to 0.25 μm is manufactured.

Next, metal wire 20 having roughened surface 21 and fiber 30 are combined (S30). For example, hybrid fiber 10 that is a covered yarn is formed by winding metal wire 20 having roughened surface 21 around fiber 30 as a core thread. Alternatively, hybrid fiber 11 that is a piled yarn is formed by placing side by side and twisting fiber 30 and metal wire 20 having roughened surface 21.

As described above, a method of manufacturing hybrid fiber 10 or 11 according to the embodiment includes a process of preparing metal wire 20 having a diameter less than or equal to a predetermined diameter (S10), a process of roughening surface 21 of prepared metal wire 20 (S20), and a process of combining metal wire 20 having roughened surface 21 and fiber 30 (S30).

In this manner, it is possible to manufacture hybrid fiber 10 or 11 having an intended function.

(Fiber Product)

Figure 4:
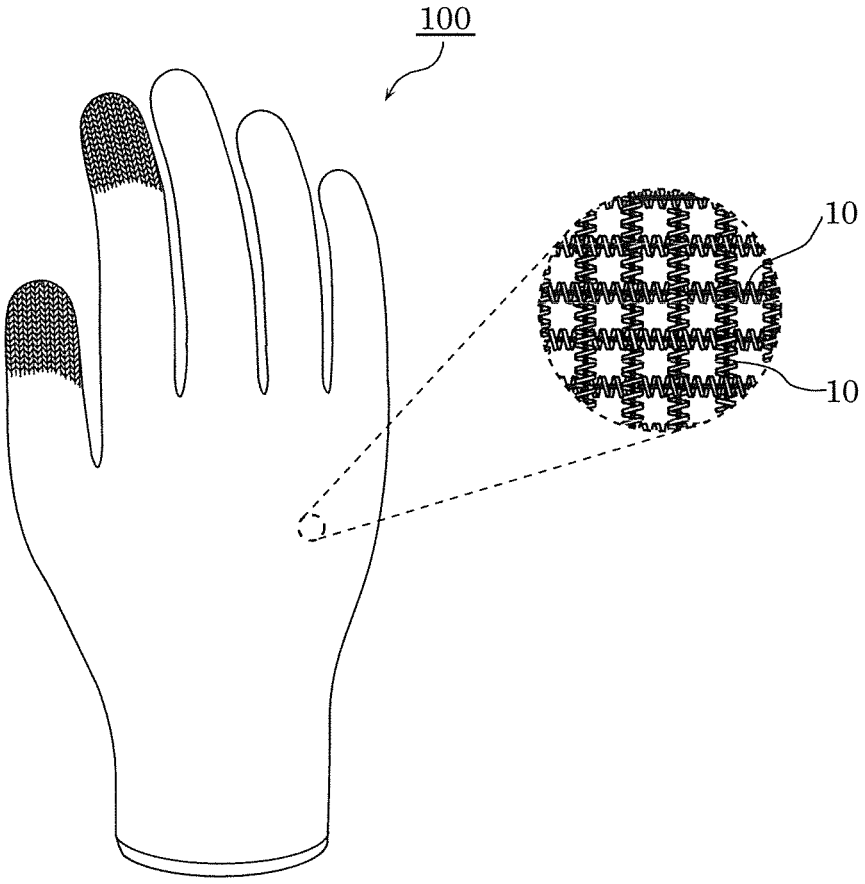
FIG. 4 illustrates an external view of a glove as an example of the fiber product according to the embodiment.

The following describes a fiber product manufactured using hybrid fiber 10 according to the embodiment. FIG. 4 illustrates an external view of glove 100 as an example of the fiber product according to the embodiment. It should be noted that, although a weave pattern is illustrated on only the tips of a thumb and an index finger in FIG. 4, the entirety of glove 100 has the weave pattern.

Glove 100 is a work glove, for example, and includes a palm portion and five finger portions. Glove 100 is manufactured by performing weaving processing using hybrid fiber 10 as warps and wefts. The weave structure of glove 100 is twill, for example (specifically, four-twill having a 2/2 twill structure). More specifically, as illustrated in FIG. 4, glove 100 is formed by passing each of a plurality of hybrid fibers 10 included in warps alternately over and under every two of a plurality of hybrid fibers 10 included in wefts.

It should be noted that the weave structure of glove 100 is not limited to the above-described example, and other weave structures such as three-twill, or four-twill having a 3/1 twill structure may be employed. Alternatively, the weave structure of glove 100 may be a plain weave or a satin weave. In addition, glove 100 may be manufactured by performing knitting processing such as stockinet with a predetermined gauge, using hybrid fiber 10 as a knitting yarn.

Although the case where glove 100 is manufactured using hybrid fiber 10 has been described above, the present disclosure is not limited to this example. Glove 100 may be manufactured using hybrid fiber 11 according to the modification example.

Furthermore, although glove 100 has been described as one example of a fiber product manufactured using hybrid fiber 10 or 11, the present disclosure is not limited to this example. The fiber product manufactured using hybrid fiber 10 or 11 may be clothing such as headwear, upper wear, lower wear, socks, underwear, belly-warmer tie, etc. Alternatively, the fiber product need not be worn by a human, and may be a tent, a sleeping bag, a bag, a flag, etc.

In addition, the fiber product may be a fiber fabric such as a woven fabric, a knitted fabric, or a non-woven fabric, which includes hybrid fiber 10 or 11 as a raw thread. The fiber fabric has a cloth-like shape or a sheet-like shape. However, the shape of the fiber fabric is not limited to these examples. For example, hybrid fiber 10 or 11 may be put into shape like cotton.

(Others)

Although the hybrid fiber according to the present disclosure has been described based on the above-described embodiment, the present disclosure is not limited to the above-described embodiment.

For example, although the case where metal wire 20 is a tungsten wire has been described in the above-described embodiment, metal wire 20 is not limited to this example. For example, metal wire 20 may be other metal wires such as a molybdenum wire, or may be an alloyed steel wire such as a stainless steel wire.

In addition, for example, although hybrid fiber 10 or 11 into which a single metal wire 20 and a single fiber 30 are combined has been described in the above-described embodiment, the number of metal wires 20 and fibers 30 combined is not limited to this example. For example, two or more metal wires 20 and a single fiber 30 may be combined. More specifically, hybrid fiber 10 may be a covered yarn including two or more metal wires 20 which are combined and wound around a single fiber 30 as a core thread. Hybrid fiber 11 may be a piled yarn in which a single fiber 30 and two or more metal wires 20 are twisted together.

Alternatively, For example, a single metal wire 20 and two or more fibers 30 may be combined. More specifically, hybrid fiber 10 may be a covered yarn including a single metal wire 20 wound around two or more fibers 30 that are combined and used as a core thread. Hybrid fiber 11 may be a piled yarn in which two or more fibers 30 and a single metal wire 20 are twisted together.

In addition, two or more metal wires 20 and two or more fibers 30 may be combined. More specifically, hybrid fiber 10 may be a covered yarn including two or more metal wires 20 which are combined and wound around two or more fibers 30 that are combined and used as a core thread. Hybrid fiber 11 may be a piled yarn in which two or more metal wires 20 and two or more fibers 30 are twisted together.

When a plurality of metal wires 20 are used, the plurality of metal wires 20 may be manufactured using the same material, or may be manufactured using different materials. For example, a tungsten wire and a molybdenum line may be used as the plurality of metal wires 20. In addition, the plurality of metal wires 20 may have the same diameter, or may have different diameters.

In addition, when a plurality of fibers 30 are used, the plurality of fibers 30 may be manufactured using the same material, or may be manufactured using different materials.

Furthermore, for example, although the case where the diameter of metal wire 20 is smaller than the diameter of fiber 30 has been described in the above-described embodiment, the diameter of metal wire 20 and the diameter of fiber 30 are not limited to this example. For example, metal wire 20 may have a diameter same as a diameter of fiber 30.

It should be noted that the present disclosure also includes other forms in which various modifications apparent to those skilled in the art are applied to the embodiment or forms in which structural components and functions in the embodiment are arbitrarily combined within the scope of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A hybrid fiber, comprising:
a metal wire having a roughened surface; and
a fiber,
wherein the metal wire and the fiber are combined, and
the metal wire has surface roughness Ra in a range from 0.15 μm to 0.25 μm.

2. The hybrid fiber according to claim 1,
wherein the metal wire is a tungsten wire.

3. The hybrid fiber according to claim 1,
wherein the metal wire has a diameter smaller than a diameter of the fiber.

4. The hybrid fiber according to claim 1,
wherein the metal wire is wound around the fiber as a core thread forming a covered yarn.

5. The hybrid fiber according to claim 1,
wherein the metal wire and the fiber are twisted together forming a piled yarn.

6. The hybrid fiber according to claim 1,
wherein the fiber is at least one of an aramid fiber and a nylon fiber.

7. A hybrid fiber, comprising:
a metal wire having a roughened surface; and
a fiber,
wherein the metal wire and the fiber are combined,
the metal wire is a tungsten wire, and
the metal wire has a diameter smaller than a diameter of the fiber.

8. The hybrid fiber according to claim 7,
wherein the metal wire is wound around the fiber as a core thread forming a covered yarn.

9. The hybrid fiber according to claim 7,
wherein the metal wire and the fiber are twisted together forming a piled yarn.

10. The hybrid fiber according to claim 7,
wherein the fiber is at least one of an aramid fiber and a nylon fiber.

11. A hybrid fiber, comprising:
a metal wire having a roughened surface; and
a fiber,
wherein the metal wire and the fiber are combined, and
the metal wire is wound around the fiber as a core thread forming a covered yarn.

12. The hybrid fiber according to claim 11,
wherein the metal wire is a tungsten wire.

13. The hybrid fiber according to claim 11,
wherein the fiber is at least one of an aramid fiber and a nylon fiber.

* * * * *